US006668385B2

(12) United States Patent
Gathings, Jr.

(10) Patent No.: US 6,668,385 B2
(45) Date of Patent: Dec. 30, 2003

(54) ADJUSTABLE INSULATION APPARATUS

(76) Inventor: Stephen A. Gathings, Jr., 2705 Al Lin Cir., Birmingham, AL (US) 35244

( * ) Notice: Subject to any disclaimer, the term of this patent is extended or adjusted under 35 U.S.C. 154(b) by 8 days.

(21) Appl. No.: 10/109,337

(22) Filed: Mar. 28, 2002

(65) Prior Publication Data

US 2003/0182708 A1 Oct. 2, 2003

(51) Int. Cl.[7] ..... A41D 3/02
(52) U.S. Cl. ..... 2/97
(58) Field of Search ..... 2/97, 102, 108, 2/69, 69.5, 93, 94, 81, 456, 458

(56) References Cited

U.S. PATENT DOCUMENTS

| | | | | |
|---|---|---|---|---|
| 2,292,348 A | * | 8/1942 | Bailey | 2/97 |
| 4,185,327 A | | 1/1980 | Markve | |
| 4,320,538 A | * | 3/1982 | Saft | 2/102 |
| 4,864,656 A | | 9/1989 | Nesse | |
| 4,914,752 A | | 4/1990 | Hinson | |
| 5,032,706 A | | 7/1991 | Goessler | |
| 5,146,625 A | | 9/1992 | Steele | |
| 5,148,002 A | | 9/1992 | Kuo | |
| 5,206,957 A | | 5/1993 | Gulick | |
| 5,305,471 A | | 4/1994 | Steele | |
| 5,713,079 A | * | 2/1998 | Simon | 2/243.1 |
| 5,718,000 A | | 2/1998 | Ost | |
| 6,128,784 A | | 10/2000 | Frank | |
| 6,189,149 B1 | | 2/2001 | Allen | |
| 6,263,510 B1 | | 7/2001 | Bay et al. | |
| 6,329,638 B1 | | 12/2001 | Bloodworth | |

OTHER PUBLICATIONS

The Met5—The North Face advertisement—one page, undated.

* cited by examiner

*Primary Examiner*—Tejash Patel
(74) *Attorney, Agent, or Firm*—Smith, Gambrell & Russell, LLP

(57) ABSTRACT

An adjustable insulation apparatus attaches to a garment to manage the body heat of the user. The apparatus includes a lining that may be extended to substantially the width of the garment worn by the user or retracted to reduce the area surrounding the user. The apparatus includes controllers for moving the lining between the extended position and the retracted position, which include extension cords and retraction cords connected to the lining. The extension cord is connected between a proximal end of the lining and an extension grip. The retraction cord is connected between the proximal end of the lining and a retraction grip. In the extended position, the lining surrounds a substantial portion of the user. When the retraction grips are drawn, the proximal end of the lining will be moved toward the distal end of the lining. To return the lining to the extended position, the user will pull the extension grips and the proximal end of the lining will move away from the distal end of the lining.

23 Claims, 12 Drawing Sheets

ADJUSTABLE INSULATION APPARATUS

FIELD OF THE INVENTION

The present invention relates to an adjustable insulation apparatus for garments, and more specifically, to an adjustable insulation for garments that may be positioned between an extended position to provide added warmth for a user's body and a retracted position to provide desired ventilation around the user's body.

BACKGROUND OF THE INVENTION

Insulated garments are well-known in the art, and are commonly used by people in a variety of activities. For example, insulated garments such as jackets or vests are frequently used by athletes to retain body heat while exercising outdoors, playing in sports, hiking, running, snow skiing, fishing or any of a variety of other outdoor activities that take place in a cold ambient temperature. The purpose of wearing such clothing is to protect the user from loss of core body temperature and to therefore maintain the desired safety and comfort by the user.

These insulated garments are important to keep the individual warm when in a cold environment, in that the garments will conserve an individual's body heat, wherein approximately ninety percent of the heat of any person's body is produced in the torso area via the major organs and muscle groups. However, as the individual engages in physical activity or as the ambient temperature increases, the amount of heat generated by the body will also increase. In order to maintain a constant core temperature as desired, the individual's body must either give up or retain this heat as necessary. The reaction of the body is largely dependent on the ambient temperature and humidity surrounding the individual.

It is commonly known that the choice of clothing can help control heat when it comes to physical activity. One of the most common suggestions to athletes and the general public is to wear multiple layers of clothing when exercising or when the temperature is expected to fluctuate significantly. By wearing multiple layers, the user can remove outer layers as necessary to adjust to the ambient temperature. Preferably, the closest layer to the skin would direct sweat away from the skin, and each additional layer would trap air that is warmed by the body to help keep the user at a comfortable and desirable temperature.

While layered clothing provides the user with an opportunity to control body heat, this solution raises additional problems. For example, one problem in wearing multiple layers of clothes is that the user often retains too much heat around the core of the body, in which case the user must either remove the unneeded layer or layers or risk overheating. For the user to be able to remove one layer, either the user has to fasten the garment to another portion of the user's body to reduce the heat surrounding the user's body (such as to tie the garment around the user's waist), or the user must discard the garment to be recovered later. In most cases, neither of these options for managing the garment is desirable to the user since they result in a significant inconvenience for the user.

Several garment devices have been developed to answer the problem of body heat control that is experienced by athletic persons and non-athletic persons alike. For example, in U.S. Pat. No. 6,329,638, a design is taught to provide a vest with a heating element to keep the user's body warm as needed. Clearly, this complicated design will overheat the user's body while on, and it is further difficult to cool down once the heating element has been in use. Similarly, U.S. Pat. No. 6,189,149 teaches the use of a vest having pockets in which to insert heat packs. Once again, this design fails to provide a convenient means for heating a person's torso while also providing a means to allow the user to cool down.

What is desired, then, and not found in the prior art, is an apparatus providing adjustable insulation within or proximate a garment. Such insulation may be positioned in an expanded manner to substantially surround the user's torso and maintain heat, or it may be retracted from that expanded position to a compact position that does not interfere with the user's activity.

SUMMARY OF THE INVENTION

An object of the present invention is to provide an adjustable insulation attached to a garment to control the body temperature of the user.

It is a further object of the present invention to provide an adjustable insulation attached to a garment that moves between an extended position and a retracted position.

It is yet a further object of the present invention is to provide a means for easily moving the adjustable insulation between the extended position and the retracted position.

An additional object of the present invention is to enable the user to regulate the user's body temperature based on climate conditions without removing the user's protective outer later.

A further object of the present invention is to minimize the exposure of a user of the present invention to the environmental forces.

These and other objects of the invention are accomplished through an adjustable insulation apparatus that is attached to a garment to provide a means for controlling the core body heat of the user. The adjustable insulation apparatus includes a lining that may be extended to substantially the full width of the garment or retracted and compressed. In the extended position, the lining substantially surrounds a portion the user's torso so that the lining will aid the user in retaining the core heat of from the user's torso. When the lining is in the retracted position, it will be compressed longitudinally to one area to reduce the area surrounding the user. As a result, the heat is allowed to dissipate from the user's body, thereby allowing the core temperature of the user's body to fall to a desirable level.

The adjustable insulation apparatus additionally includes a control assembly for easily moving the lining between the extended position and the retracted position. The control assembly preferably includes a plurality of extension cords and a plurality of retraction cords that are all attached to the proximal end of the lining, with the extension cords being positioned opposite to the respective retraction cords. One end of each of the extension cords is connected to the proximal end of the lining, and the extension cords extend from the lining to a collection member, where each extension cord traverses the collection member to connect with an extension grip. Similarly, the retraction cords are also attached to substantially the proximal end of the lining, with each retraction cord extending proximate the lining to engage a collection member. Each retraction cords traverse the collection member to connect with a retraction grip.

In operation of the preferred embodiment, the lining is initially in the extended position such that the lining stretches around a substantial portion of the torso of the user and the extension cords hang from the collection member. In this position, the lining will help to maintain the core temperature of the user at a desired level. However, when the user needs to release some of the heat, the user will pull the retraction grips. By pulling the retraction grips, the proximal end of the lining will be moved toward the distal end of the lining. As a result, the lining will be compressed into one location, such that the lining substantially does not surround the user. To return the lining to the extended position, the user will pull the extension grips, and the proximal end of the lining will move away from the distal end of the lining. The lining will once again be stretched around the torso of the user.

These and other objects and advantages of the invention will become apparent from the following detailed description of the preferred embodiment of the adjustable insulation apparatus.

BRIEF DESCRIPTION OF THE DRAWINGS

An adjustable insulation apparatus embodying the features of the present invention is depicted in the accompanying drawings which form a portion of this disclosure and wherein.

DESCRIPTION OF THE PREFERRED EMBODIMENT

Figure 1:
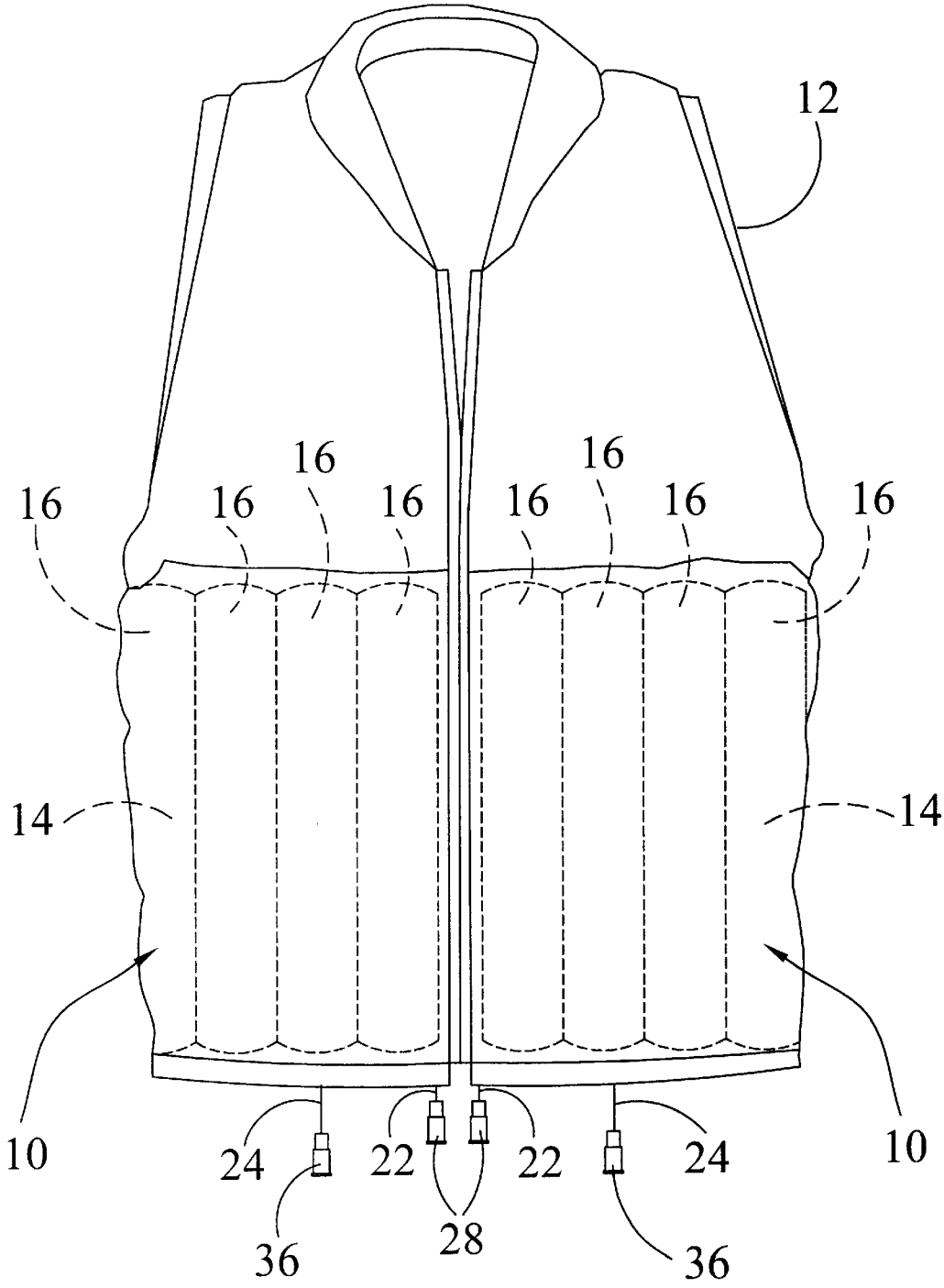
FIG. 1 is a front elevational view of a garment having the adjustable insulation apparatus, with a portion of the adjustable insulation apparatus being illustrated in phantom.
Figure 2:
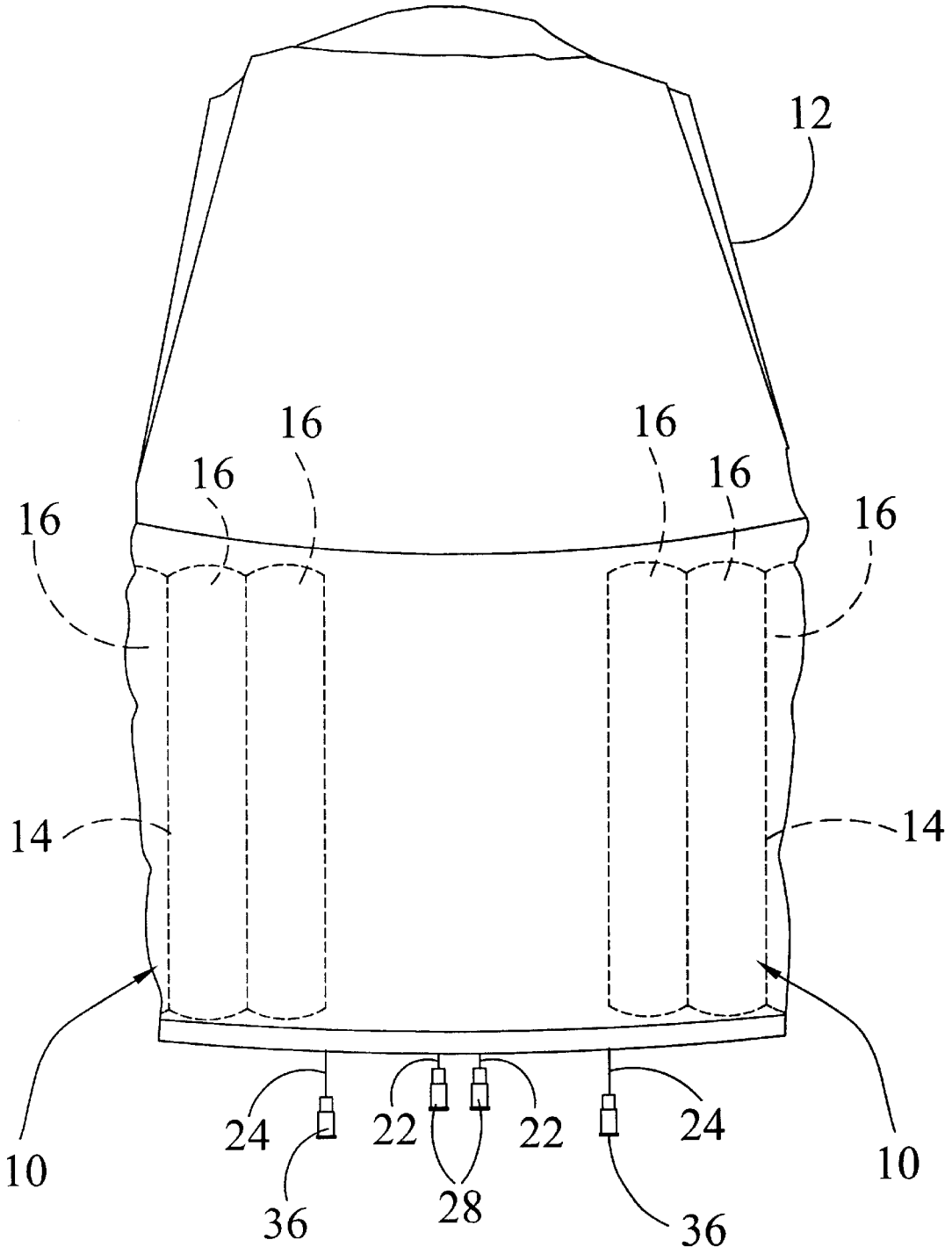
FIG. 2 is a rear elevational view of a garment having the adjustable insulation apparatus, with a portion of the adjustable insulation apparatus being illustrated in phantom.
Figure 3:
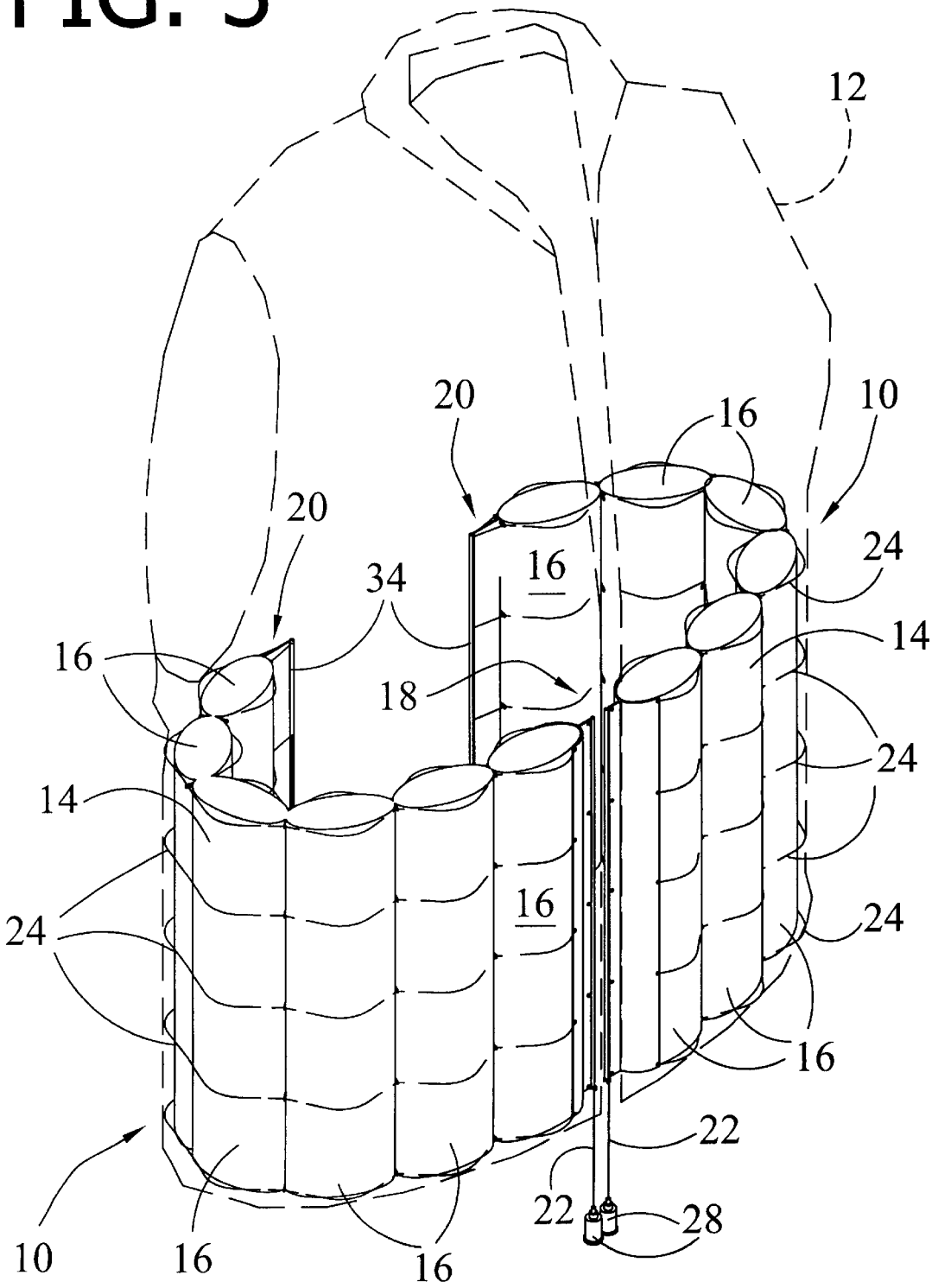
FIG. 3 is a front perspective view of the adjustable insulation apparatus of the present invention, with the adjustable insulation apparatus being attached to a garment in phantom in an extended position.
Figure 4:
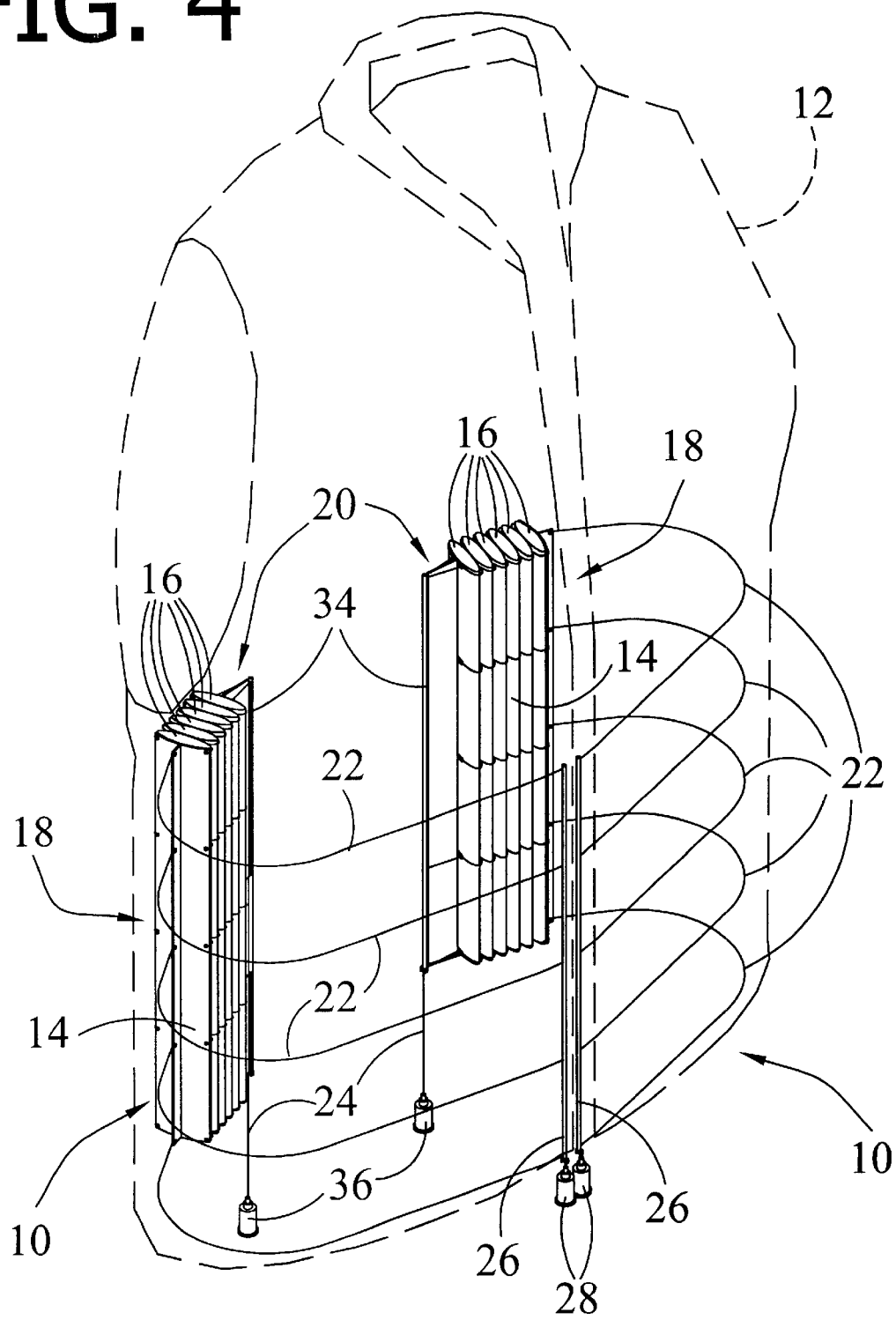
FIG. 4 is a front perspective view of the apparatus as illustrated in FIG. 3, with the adjustable insulation apparatus being in a retracted position.

Looking now to FIGS. 1 through 4 for a greater understanding of the present invention, the present invention of an adjustable insulation apparatus 10 is shown attached to two sides a garment 12 or textile shell, such as a vest or jacket. The adjustable insulation apparatus 10 is attached to the garment 12 to provide a means for controlling the core body heat of the user. In the preferred embodiment, two separate versions of the adjustable insulation apparatus 10 are attached to opposing sides of the garment 12, with each adjustable insulation apparatus 10 including a lining 14. As a result, the lining 14 will be joined to the garment 12 such that the lining 14 may be extended to substantially the full width of the garment 12 (as shown in FIGS. 1, 2 and 3), or such that the lining 14 may be retracted and compressed (as shown in FIG. 4). In the extended position, the lining 14 will substantially surround the torso of the user such that the lining 14 aids in retaining the core heat of from the torso of the user. To the contrary, when the lining 14 is in the retracted position, the lining 14 will be compressed longitudinally to one area, thereby significantly reducing the area that the lining 14 covers the user. As a result, the heat is allowed to dissipate from the user's body, thereby allowing the core temperature of the user's body to fall to a desirable level.

Figure 5:
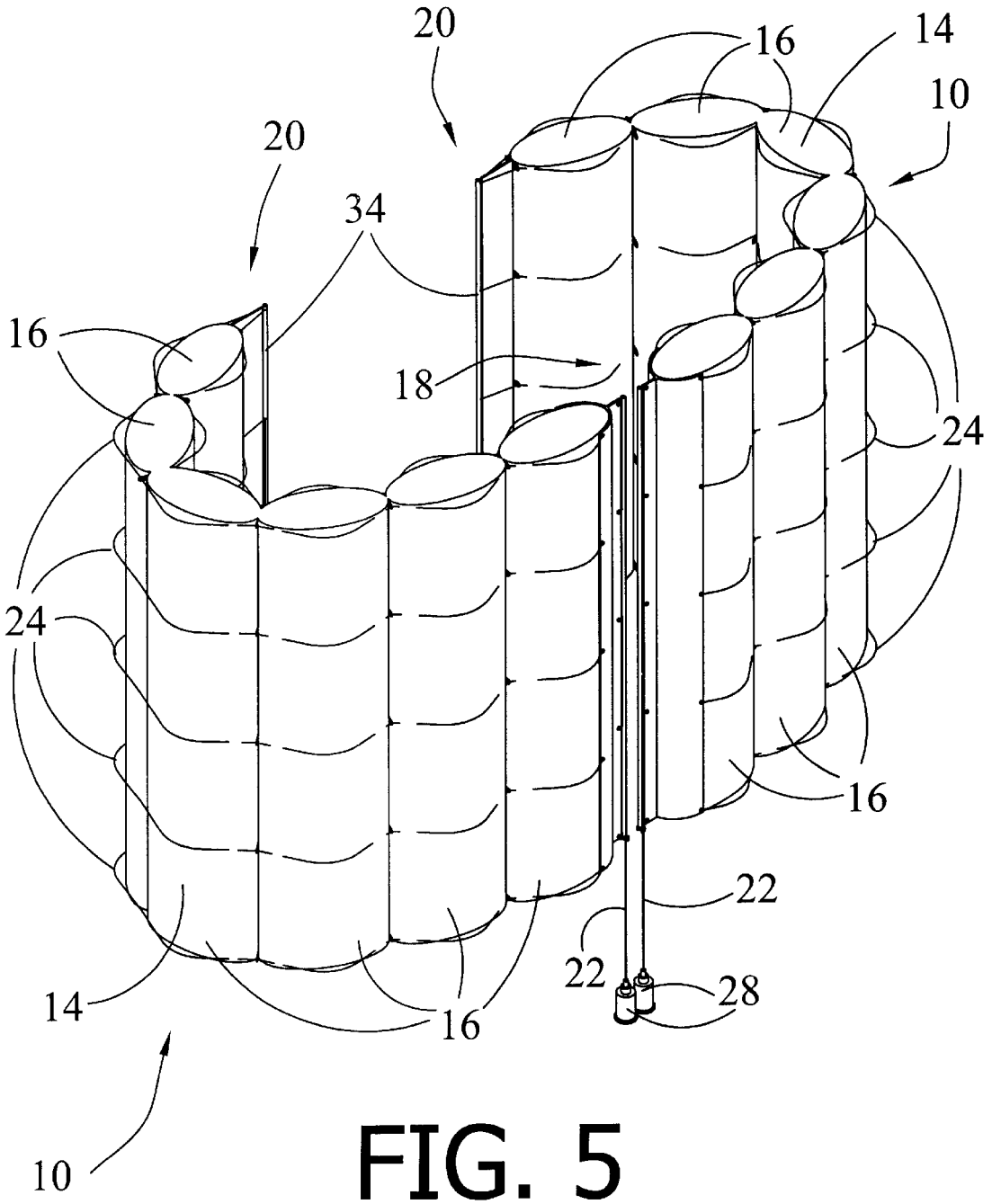
FIG. 5 is a front perspective view of the present invention, with the lining being in the extended position.
Figure 6:
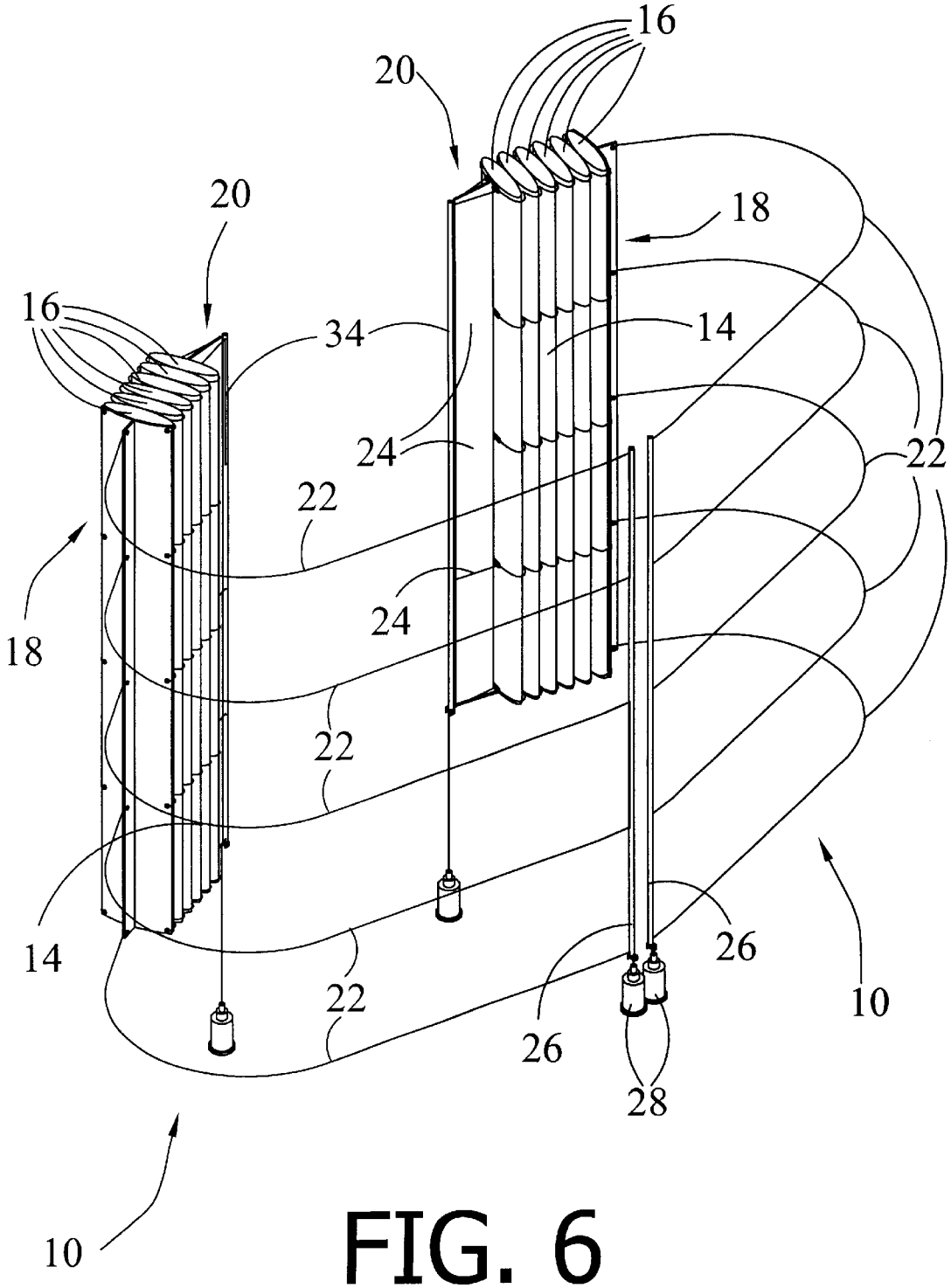
FIG. 6 is a front perspective view of the present invention, with the lining being in the retracted position.
Figure 7:
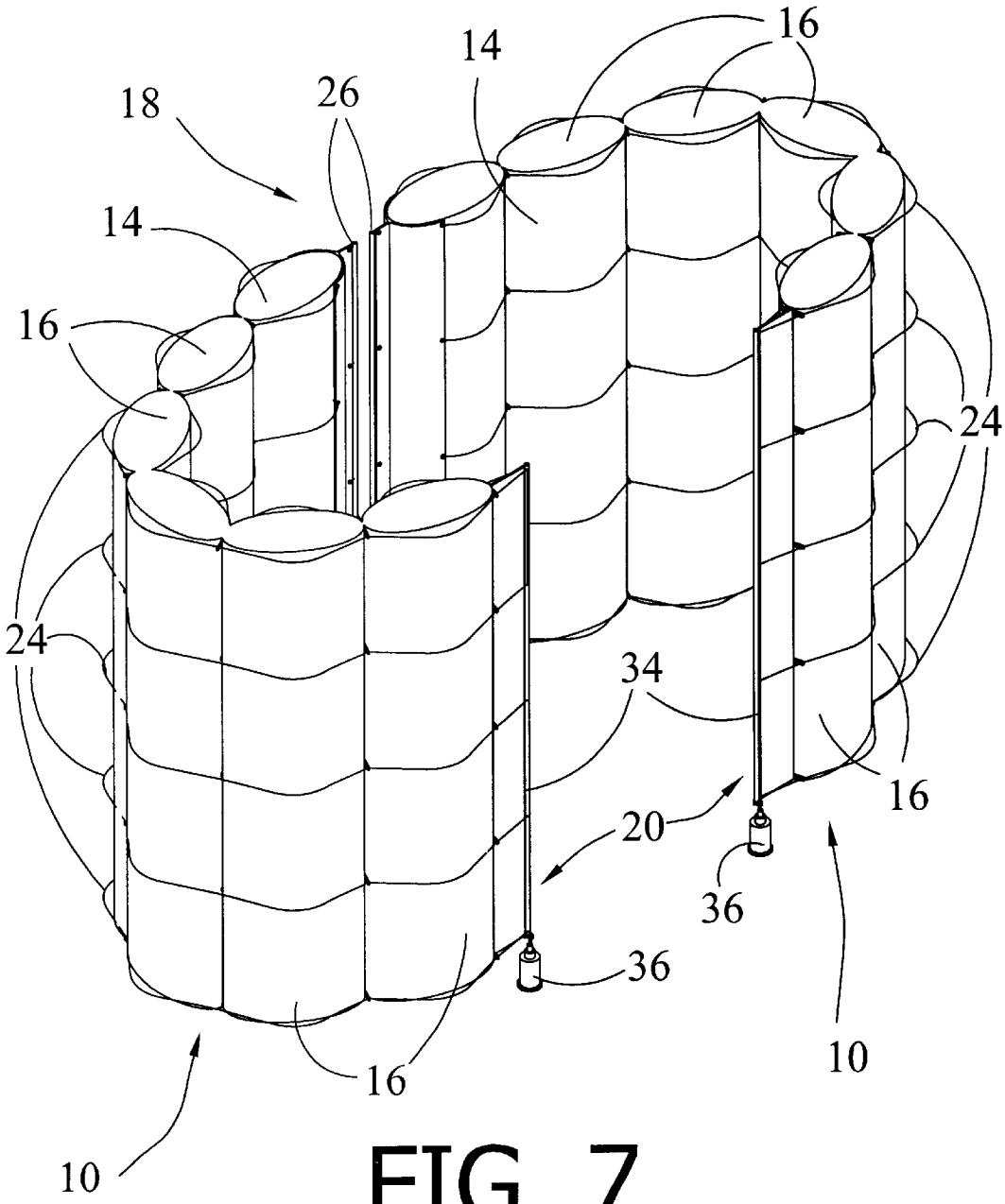
FIG. 7 is a rear perspective view of the present invention, with the lining being in the extended position.
Figure 8:
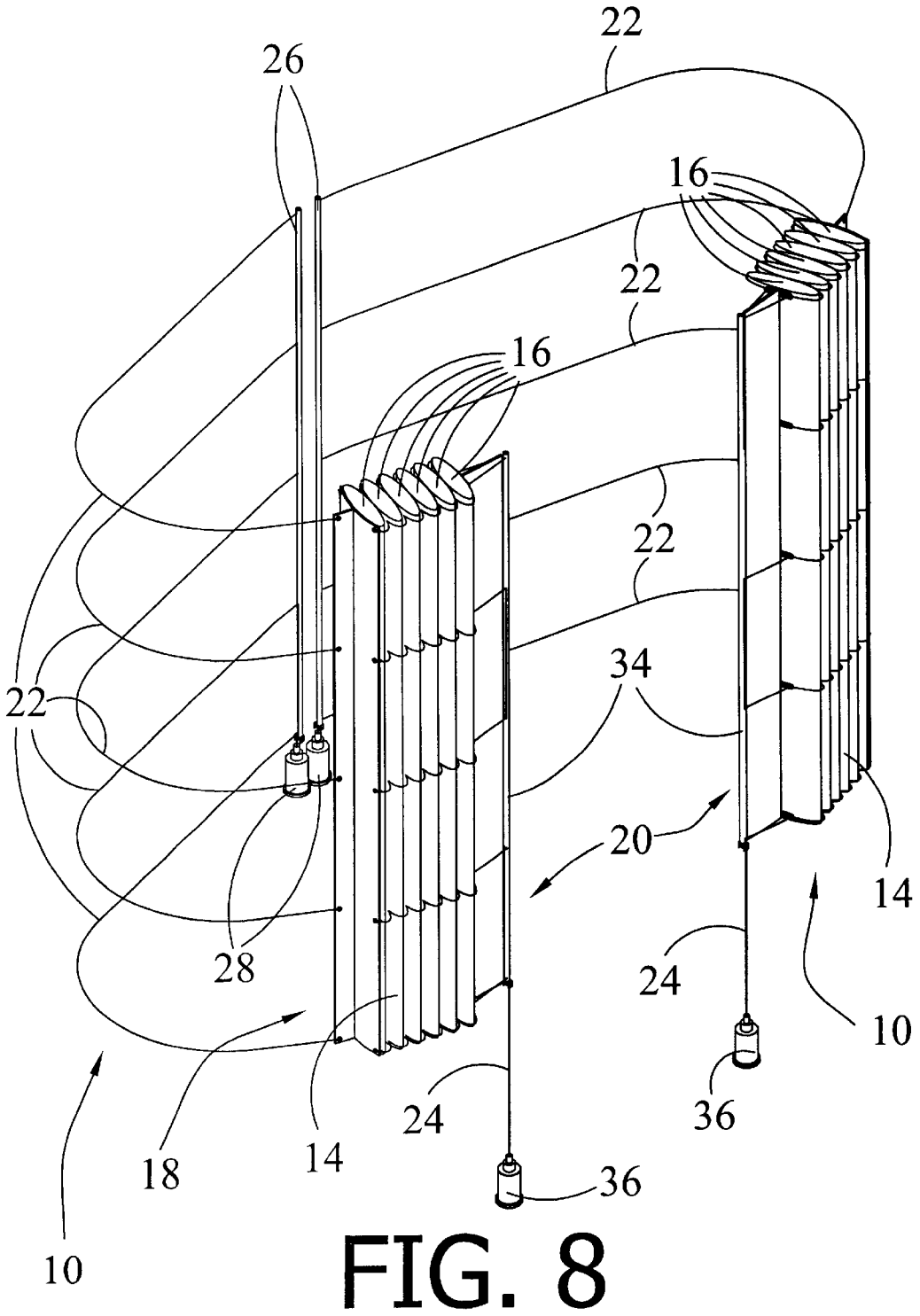
FIG. 8 is a rear perspective view of the present invention, with the lining being in the retracted position.

Looking to FIGS. 5 and 6, the lining 14 of the adjustable insulation apparatus 10 includes a series of baffled, insulated panels 16 that are flexible to be easily stretched or compressed. The lining 14 preferably is a rectangular sheet of an insulating material having a proximal end 18 and a distal end 20, although the lining 14 can be any shape desired by the user. Moreover, the lining 14 may be made of any natural or synthetic material having the properties desired by the user, with the preferred embodiment being made of a synthetic material commonly known by the trademark POLARGUARD®.

Looking at FIGS. 3 through 6, the adjustable insulation apparatus 10 further includes a control assembly as a means for moving or sliding the lining 14 between an extended position (as shown in FIGS. 3 and 5) and in a retracted position (as shown in FIGS. 4 and 6). In the preferred embodiment, the control assembly includes a plurality of extension cords 22 and a plurality of retraction cords 24. Both the extension cords 22 and the retraction cords 24 may be made of any natural or synthetic material having the properties desired by the user, with the preferred embodiment being made of a synthetic material commonly known by the trademark DYNEEMA®. Looking particularly to FIGS. 5 and 6, both the extension cords 22 and the retraction cords 24 are attached to the proximal end 18 of the lining 14, with the extension cords 22 being positioned opposite to the respective retraction cords 24.

Figure 10A:
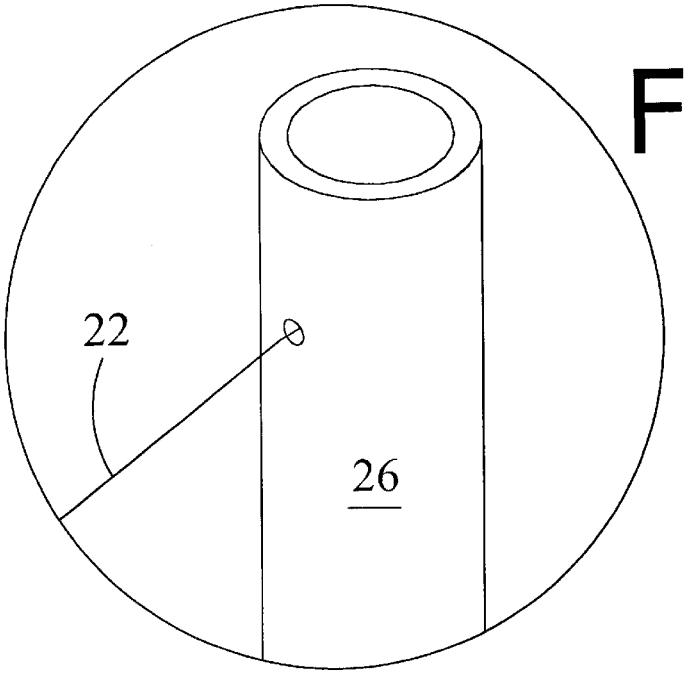
FIGS. 10*a* and 10*b* are magnified perspective views of the intersection of the extension cord and retraction cord with the collection member of the present invention.

In the preferred embodiment, one end of each of the extension cords 22 is connected to the proximal end 18 of the lining 14 and extends from the lining 14 to a proximal collection member 26. Looking at FIGS. 6 and 10*a*, the extension cords 22 engage the proximal collection member 26 and traverse the proximal collection member 26 to connect with an extension grip 28. The proximal collection member 26 is preferably connected with the garment 12, and the connection may be completed in any of numerous ways known in the art, such as being sewn to the garment 12 or attached by glue. The proximal collection member 26 serves to collect the various extension cords 22 as desired by the user. Moreover, it should further be noted that while the preferred embodiment of the proximal collection member 26 is cylindrical, other embodiments for collecting the extension cords 22, such as rings, brackets, mesh cloth, or related devices, could be use in place of the embodiment shown in FIG. 6.

Figure 10B:
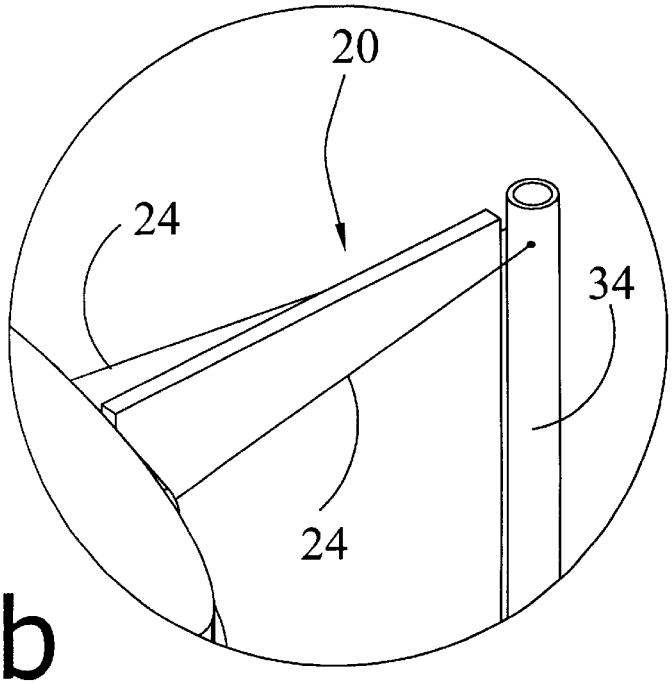
Figure 11:
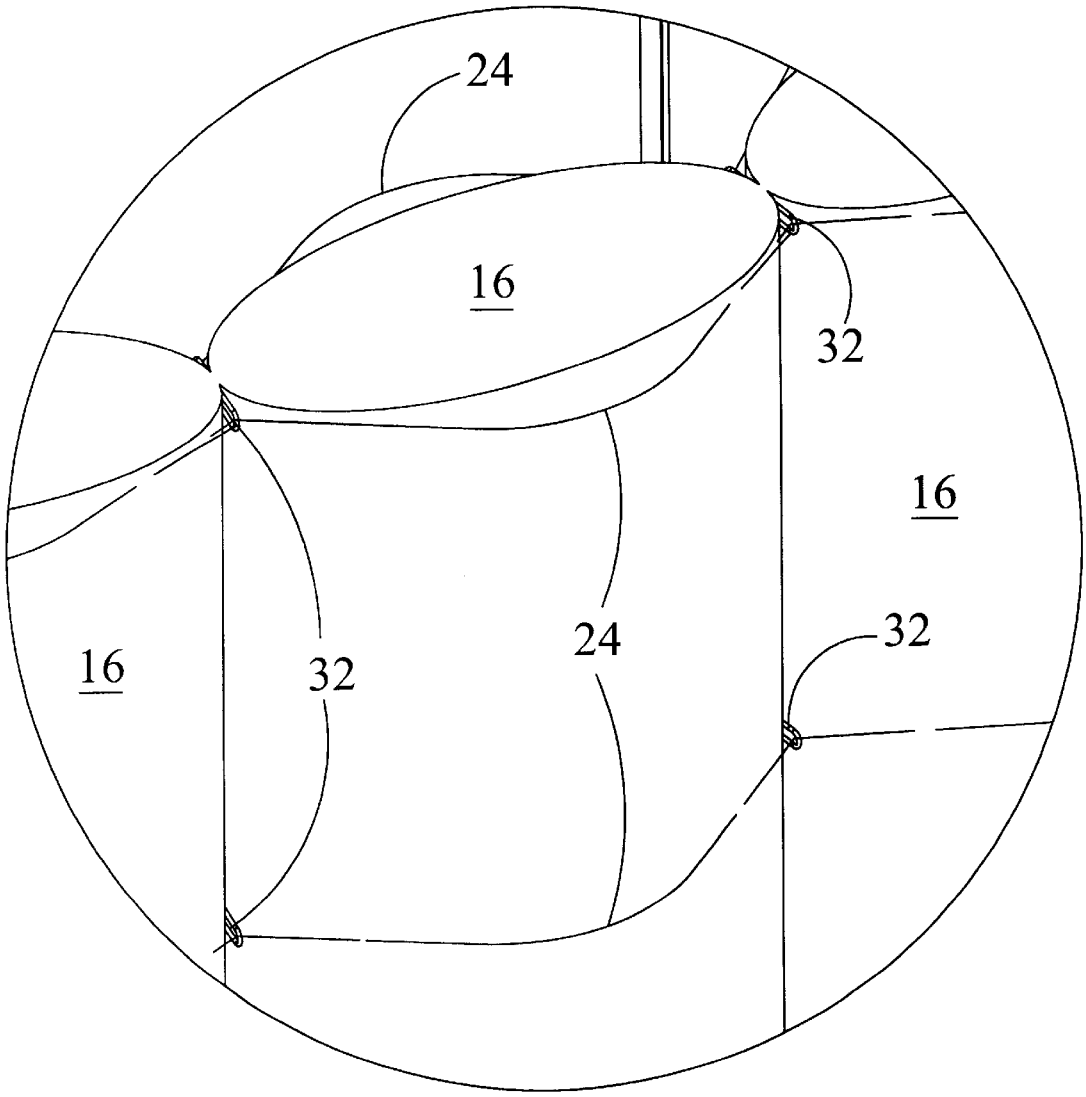
FIG. 11 is a magnified perspective view of the positioning brackets of the present invention.

Looking to FIGS. 3, 5, 7, and 8, the retraction cords 24 are also attached to substantially the proximal end 18 of the lining 14. However, unlike the extension cords 24, the preferred embodiment of the present design includes two retraction cords 24 attached to opposite sides of the lining 14 at substantially the same position on the respective sides, with each retraction cord 24 traveling across the opposing side of the lining 14. The retraction cords 24 will either intersect the lining 14 at respective points, or they will traverse positioning brackets 32 or loops that are attached to the lining 14 as shown in FIG. 11. In the preferred embodiment, the positioning brackets 32 will verify that each retraction cord 24 is substantially parallel to the other respective retraction cords 24, which assures that the lining 14 will be retracted in an even fashion. The retraction cords 24 further extend from the lining 14 to engage a distal collection member 34 (see FIGS. 8 and 10*b*). The retraction cords 24 thereby engage the distal collection member 34 and traverse the distal collection member 34 to connect with a retraction grip 36. The distal collection member 34 is preferably integrated with the garment 12, and serves to collect the various retraction cords 24 as desired by the user. Moreover, as discussed with the proximal collection member 26 above, it should further be noted that while the preferred embodiment of the distal collection member 34 is a cylindrical tube, other embodiments for collecting the cords, such as various independent rings, brackets, or mesh, could be use in place of the embodiment shown in FIG. 6.

In operation of this embodiment, the lining 14 is initially in the extended position such that the lining 14 substantially stretches around the torso of the user and the extension cords 22 hang from the proximal collection member 26. In this position, the lining 14 will help to keep heat near the user and therefore maintain the core temperature of the user at a desired level in a cold ambient environment. However, when the user needs to release some of the heat, the user will pull the retraction grips 36. By pulling the retraction grips 36 as shown in FIG. 5, the proximal end 18 of the lining 14 will be moved toward the distal end 20 and the extension cords 22 will be moved in the direction of the pulling force. As a result, the lining 14 will be compressed into one location as shown in FIG. 6, such that the lining 14 will minimally engage and surround the user. Preferably, the retracted panels 16 of the lining 14 are positioned inconspicuously proximate the arms of the user, such as under or behind the arms of the user. As a result, the lining 14 will not be in the position to prevent heat from being released through the garment 12, thus lowering the core temperature of the user.

To return the lining 14 to the extended position, the user will simply pull the extension grips 28. At this point, the proximal end 18 of the lining 14 will move away from the distal end 20 of the lining 14, and the lining 14 will once again be stretched around a substantial portion of the torso of the user. In addition, the retraction cords 24 will be moved in the direction of the pulling force.

Figure 9A:
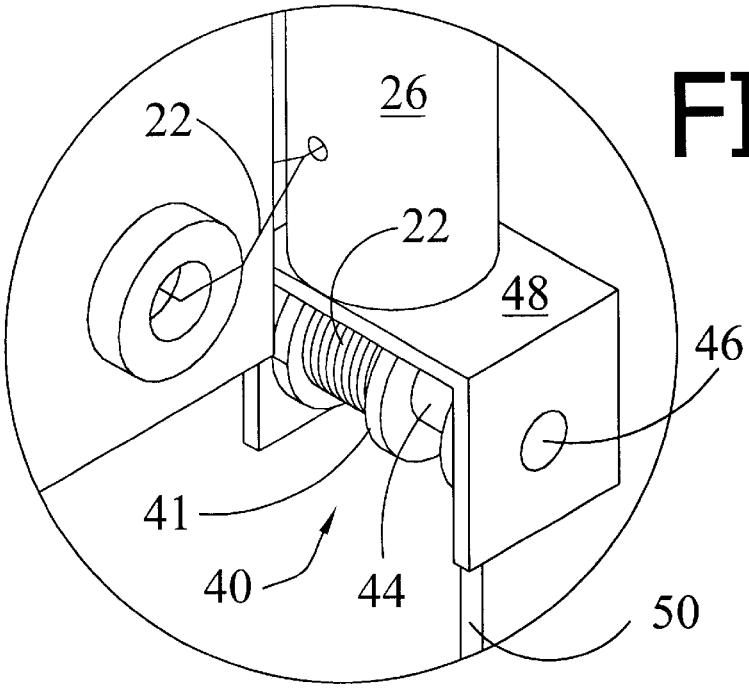
FIGS. 9*a* and 9*b* are magnified views of the cord collection members.
Figure 9B:
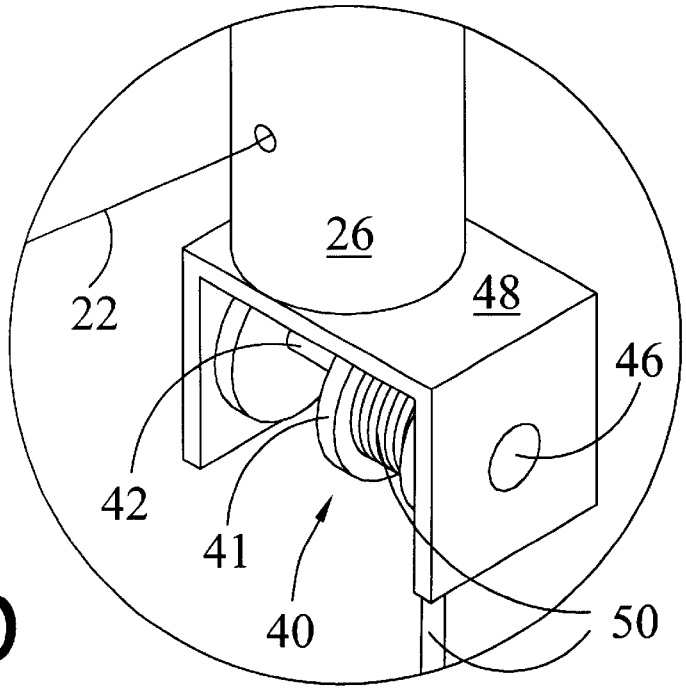

Looking to FIGS. 9*a* and 9*b*, the adjustable insulation apparatus 10 may additionally include a cord collection member 40 in place of the extension grips 28 or the retraction grips 36 for controlling the loose line of either the extension cord 22 or the retraction cord 24. The cord collection member 40 preferably includes a collection cylinder 41 having a first cylindrical segment 42 and a second cylindrical segment 44, with the collection cylinder 41 being rotatably mounted on a shaft 46 within a bracket 48. The first cylindrical segment 42 of the cord collection member 40 abuts the second cylindrical segment 44, and the first cylindrical segment 42 has a first diameter while the second cylindrical segment 44 has a second diameter. The diameter of the second cylindrical segment 44 is substantially greater than the diameter of the first cylindrical segment 42 (see FIG. 9*b*). A pull cord 50 is connected to the collection cylinder 41 and is wound around the second cylindrical segment 44. Either the extension cord 22 or the retraction cord 24 will be attached to the collection cylinder 41 such that the extension or retraction cord 22, 24 will loop over the first cylindrical segment 42 (see FIG. 9*a*). As a result, the user is able to draw the pull cord 50 and wind the loose extension or retraction cord 22, 24 around the second cylindrical segment 44. Moreover, wrapping the cord around the first cylindrical segment 42 will reduce the looseness of any cord hanging from the garment 12. Since the diameter of the first cylindrical segment 42 is smaller than that of the second cylindrical segment 44, the cords will wrap around the first cylindrical segment 42 more quickly than the pull cord 50 will be unwound from the first cylindrical segment 42.

Figure 12B:
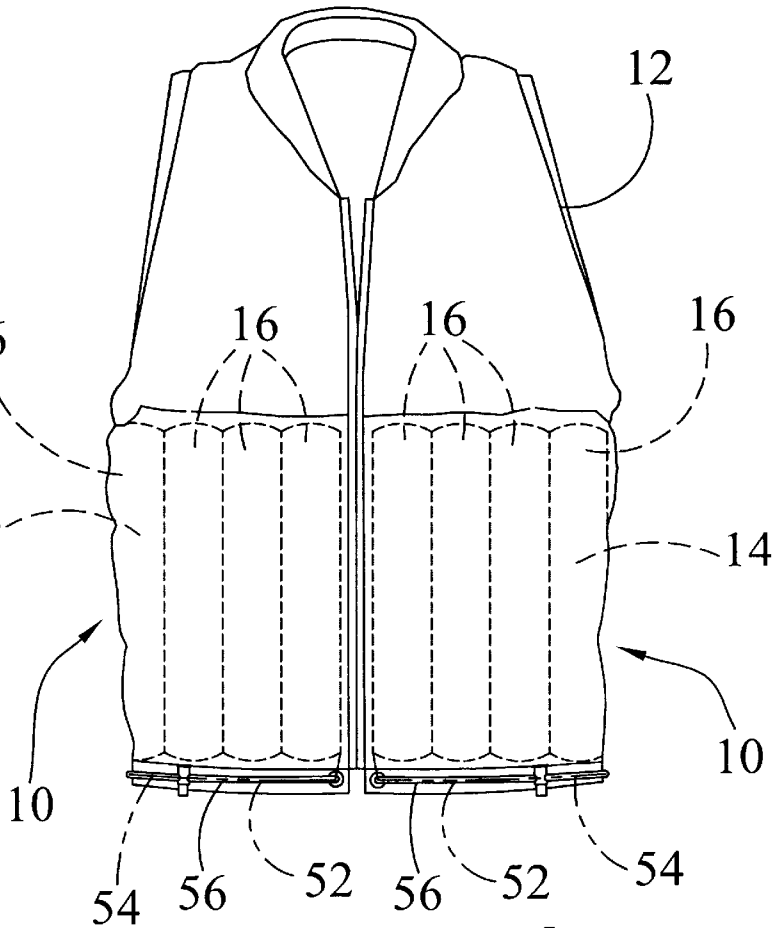
FIGS. 12*a* and 12*b* are front elevational views of a second embodiment of the adjustable insulation apparatus of the present invention.
Figure 12A:
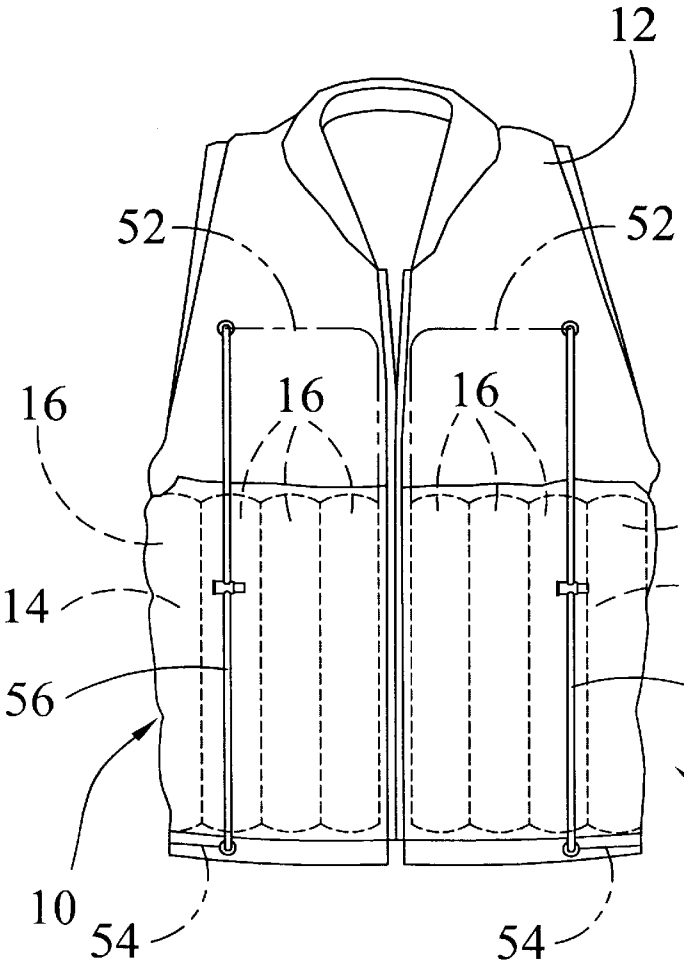

In addition to the first embodiment for the control assembly described above, other similar embodiments are to be expected. For example, a second embodiment is illustrated in FIGS. 12*a* and 12*b*, wherein the control assembly includes a series of extension cords 52 and an equal number of retraction cords 54. In this embodiment, rather than have unattached ends of the extension cords 52 and retraction cords 54 as in the previous embodiment, the extension cords 52 are connected to respective retraction cords 54. As a result of the connection between the extension cords 52 and retraction cords 54, a section 56 of the cords 52, 54 can extend outside of the garment 12 to be controlled by the user. Hence, one pulling motion will adjust both sets of cords 52, 54 to move the lining 14 between the extended position and the retracted position. More importantly, by connecting the extension cords 52 with the retraction cords 54, the user is able to adjust the lining 14 without having problems with loose and unattached ends of the extension cords 52 and the retraction cords 54.

It should further be explained that the garment 12 shown in the preferred embodiment is a vest, although the present invention could be used with or in essentially any other type of garment. Moreover, it should also be noted in garments 12 having an inner shell and an outer shell, the adjustable insulation apparatus 10 can be incorporated in the garment 12 between the inner shell and the outer shell. In this case, the lining 14 would be sandwiched between the inner shell and the outer shell. In contrast, the lining 14 may be attached to either shell as desired by the manufacturer of the garment 12. In addition, the adjustable insulation apparatus 10 may be added to preexisting garments 12 by simply attaching the adjustable insulation apparatus 10 to the inner surface of the garment 10.

Thus, although there have been described particular embodiments of the present invention of a new and useful ADJUSTABLE INSULATION APPARATUS, it is not intended that such references be construed as limitations upon the scope of this invention except as set forth in the following claims.

What is claimed is:

1. An adjustable insulation apparatus attached to a garment, the adjustable insulation apparatus comprising:

a lining having a proximal end and a distal end, said distal end coupled to the garment; and a control assembly to move said lining about the garment, said control assembly being connected to said proximal end of said lining;

wherein said control assembly positions said lining between a non-insulating position and an insulating position.

2. The adjustable insulation apparatus as described in claim 1, wherein said lining comprises an insulated material.

3. The adjustable insulation apparatus as described in claim 1, wherein said control assembly comprises at least one extension cord having a first end and a second end, wherein said first end of said at least one extension cord is connected to said proximal end of said lining.

4. The adjustable insulation apparatus as described in claim 3 further comprising a proximal collection member connected to the garment, wherein said at least one extension cord traverses said proximal collection member.

5. The adjustable insulation apparatus as described in claim 4 wherein said proximal collection member comprises a tube.

6. The adjustable insulation apparatus as described in claim 4 wherein said proximal collection member comprises at least one ring.

7. The adjustable insulation apparatus as described in claim 3 further comprising a cord retraction cylinder including a first cylindrical segment having a first diameter; and a second cylindrical segment having a second diameter greater than said first diameter, said second cylindrical segment abutting said first cylindrical segment; and a pull cord wound around said second cylindrical segment;

wherein said at least one extension cord engages said first cylindrical segment.

8. The adjustable insulation apparatus as described in claim 3, wherein said control assembly comprises at least one retraction cord having a first end and a second end, wherein said first end of said at least one retraction cord is connected to said proximal end of said lining.

9. The adjustable insulation apparatus as described in claim 8 further comprising a distal collection member connected to the garment, wherein said at least one retraction cord traverses said distal collection member.

10. The adjustable insulation apparatus as described in claim 9 wherein said distal collection member comprises a tube.

11. The adjustable insulation apparatus as described in claim 9 wherein said distal collection member comprises at least one ring.

12. The adjustable insulation apparatus as described in claim 8 further comprising at least one positioning bracket connected to said lining, wherein said at least one retraction cord traverses said positioning bracket.

13. The adjustable insulation apparatus as described in claim 8, wherein said second end of said at least one retraction cord is connected to said second end of said at least one extension cord.

14. The adjustable insulation apparatus as described in claim 3, further comprising:

a first retraction cord attached to said proximal end of said lining and crossing said lining toward said distal end wherein said first retraction cord is substantially orthogonal to said proximal end and said distal end;

a second retraction cord attached to said proximal end of said lining and crossing said lining toward said distal end wherein said second retraction cord is substantially orthogonal to said proximal end and said distal end, and said second retraction cord is substantially parallel to said first retraction cord;

a plurality of first support brackets connected to said lining in a first row, wherein said first retraction cord traverses said first support brackets; and a plurality of second support brackets connected to said lining in a second row, wherein said second retraction cord traverses said second support brackets.

15. The adjustable insulation apparatus as described in claim 1 wherein said lining comprises a synthetic fiber material.

16. A garment having adjustable insulation for regulating the temperature of a user's body, said garment comprising:

a shell;

a lining having a first end and a second end, said second end of said lining connected to said shell; and moving means for repositioning said lining between a retracted position and an extended position, said moving means connected to said first end of said lining.

17. The garment as described in claim 16 wherein said moving means comprises:

at least one retraction cord having a first end and a second end, said second end being connected to said first end of said lining; and at least one extension cord having a first end and a second end, said first end being connected to said first end of said lining;

wherein said lining retracts when said unattached end of said retraction cord is drawn and wherein said lining extends when said unattached end of said extension cord is drawn.

18. The garment as described in claim 17 wherein said moving means further comprises:

a proximal collection member attached to the garment, wherein each said extension cord traverses said proximal collection member; and a distal collection member attached to the garment, wherein each said retraction cord traverses said distal collection member.

19. The garment as described in claim 16 wherein said moving means comprises:

at least one retraction cord having an affixed end and a control end, wherein said affixed end is attached to said first end of said lining; and at least one extension cord having an affixed end a control end, wherein said affixed end is attached to said first end of said lining and said control end of said extension cord is attached to said control end of said retraction cord.

20. An adjustable insulation apparatus affixed to a garment, the adjustable insulation apparatus comprising:

an insulating material having a proximal end and a distal end, said distal end coupled to the garment; and moving means for repositioning said lining between an insulated position substantially surrounding the garment and a non-insulated position bordering a portion of the garment, said moving means connected to a first end of said insulating material.

21. The adjustable insulation apparatus as described in claim 20, wherein said moving means comprises at least one extension cord having a first end and a second end, wherein said first end of said at least one extension cord is connected to said proximal end of said insulating material.

22. The adjustable insulation apparatus as described in claim 20, wherein said moving means comprises at least one retraction cord having a first end and a second end, wherein said first end of said at least one retraction cord is connected to said proximal end of said lining.

23. The adjustable insulation apparatus as described in claim 20, wherein said moving means further comprises:

a first retraction cord attached to said proximal end of said insulating material and crossing said insulating material toward said distal end wherein said first retraction cord is substantially orthogonal to said proximal end and said distal end;

a second retraction cord attached to said proximal end of said lining and crossing said lining toward said distal end wherein said second retraction cord is substantially orthogonal to said proximal end and said distal end, and said second retraction cord is substantially parallel to said first retraction cord;

a plurality of first support brackets connected to said lining in a first row, wherein said first retraction cord traverses said first support brackets; and a plurality of second support brackets connected to said lining in a second row, wherein said second retraction cord traverses said second support brackets.

* * * * *